US005093991A

United States Patent [19]

Hendrickson

[11] Patent Number: 5,093,991

[45] Date of Patent: Mar. 10, 1992

[54] ADJUSTABLE RAZOR

[76] Inventor: Terrance M. Hendrickson, 11541 Zion Rd., Bloomington, Minn. 55438

[21] Appl. No.: 608,827

[22] Filed: Nov. 5, 1990

[51] Int. Cl.[5] ..... B26B 21/28

[52] U.S. Cl. ..... 30/89; 30/87; 403/97

[58] Field of Search ..... 30/88, 89, 87; 403/97

[56] References Cited

U.S. PATENT DOCUMENTS

| | | | |
|---|---|---|---|
| 1,351,826 | 9/1920 | Allen | 30/89 |
| 1,593,459 | 7/1926 | MacFalls | 30/53 |
| 2,002,298 | 5/1935 | Segal | 30/12 |
| 2,060,445 | 11/1936 | Ryley | 30/85 |
| 2,119,792 | 6/1938 | Parkin | 30/89 |
| 2,165,046 | 7/1939 | Greenstein | 30/51 |
| 2,609,251 | 4/1947 | Haupt | 403/97 |
| 3,964,160 | 6/1976 | Gordon | 30/89 |
| 4,128,937 | 12/1978 | Adorney | 30/47 |
| 4,335,509 | 6/1982 | Smith | 30/48 |

*Primary Examiner*—Mark Rosenbaum
*Assistant Examiner*—Raymond D. Woods
*Attorney, Agent, or Firm*—Andrus, Sceales, Starke & Sawall

[57] ABSTRACT

The adjustable safety razor has a handle assembly having an elongated handle member terminating in a mounting boss having a forwardly orientated disc-like mating face. It has a shaving razor head assembly having a rearward mounting boss with a rearwardly oriented disc-like mating face. Each mating face is formed to have a plurality of radial grooves and ridges. The radial grooves and ridges of one mating face are a mirror complement of the radial grooves and ridges of the other mating face. Means is provided for yieldably biasing the mating faces together in intermeshed condition. The shaving head assembly is thus adjustable with respect to the handle assembly by indexed rotation of the mating face of one assembly with respect to the other.

4 Claims, 1 Drawing Sheet

ADJUSTABLE RAZOR

BACKGROUND OF THE INVENTION

This invention relates to an adjustable shaving razor having a shaving razor head conveniently changeable in angularity with respect to the handle member of the razor.

More particularly, the invention relates to a new razor having an adjustable razor head easily changed in angularity with respect to the handle member by simple finger action. The head is maintained in any selected angular condition with respect to the handle member by intermeshing disc-like mating surfaces yieldably biased together but easily shifted with respect to each other by notch-like indexing movement. Indexing movement of one mating surface with respect to the other effects change of the angular condition of the transverse head with respect to the handle.

The standard safety razors commercially available have a razor head which is essentially perpendicular to the elongated handle portion thereof. When the handle is pulled in a direction common to its length, which habitually is the technique most people employ in shaving, the result is that the blade cutter or cutters of the razor head attack each hair or bristle in a relatively "head-on" manner. The result is "tearing" instead of angularly slicing the hairs or bristles to be removed, as well as relatively rapid clogging of the razor head. One would not use a blade in that manner to plow snow or grade a road, but that manner has been the historical and habitual way that safety razor shaving has heretofore been conducted.

The shaving of unwanted hair from a person's body generally becomes more and more irritating to the skin as the bristles of hair become tougher and tougher and require more and more shaving strokes to achieve effective removal using the conventional "head-on" action aforedescribed. Reduction of the number of shaving strokes by employing a slicing action on the unwanted hair can contribute to reduced skin irritation.

The desirability of employing a slanted razor heat to achieve slicing action in cutting off undesired hair in shaving has long been recognized, as is evident from prior patent teachings dealing with slanted safety razor heads. However, insofar as is known, prior art patent teachings of slanted razor heads either require a fixed slant angle for the transverse razor head with respect to the handle or a relatively complex and expensive structural arrangement for adjustment of the razor head to varied desired angles as determined by the user to be the most effective for his or her purposes.

The teaching of this invention presents a new solution permitting extraordinary versatility for the angular orientation of the transverse razor head with respect to the razor handle while at the same time achieving this result with exceeding economy and simplicity of structural arrangement.

SUMMARY OF THE INVENTION

The new adjustable safety razor of the invention has certain elements which are basically common to all safety razors of known character. A razor of this invention, for example, has an elongated handle member. It has a razor head assembly. But according to the teaching of this invention, these two basic elements each extend from and are equipped with a mounting boss having a mating face. Each mating face has a plurality of radial grooves and ridges. The mating face of the mounting boss on the razor head has radial grooves and ridges which matingly intermesh with the radial grooves and ridges of the mating face of the mounting boss on the handle member. Thus the radial ridges of one mating face fit into the radial grooves on the other mating face, and vice versa. In this manner the relative rotational orientation of one mating face with respect to the other is easily changed, with the result that intermeshing of the radial grooves and ridges of one member with the radial grooves and ridges of the other is accomplished regardless of the relative rotational orientation of one mating face with respect to the other. Yieldable biasing means maintains the mating faces together but permits notch-like indexing shift of one mating face with respect to the other, and thus relative shift of the angular relationship of the transverse shaving razor head with respect to the elongated handle member of the razor.

The preferred biasing means comprises a spring means of some sort yieldably urging the mating faces of the mounting bosses together. They are urged together into a more or less interlocked condition which is easily "unlocked" to permit rotary notch-like indexing shift of one mating face with respect to the other.

Thus the structure of the new adjustable razor is exceedingly simple and economical in its design of critical elements and yet is fully effective to allow versatility for the orientation of the transverse shaving head with respect to the handle member to whatever angle any user may specifically desire for maximum shaving comfort and effectiveness of bristle or hair removal with the fewest possible shaving strokes and therefore the lowest level of skin irritation.

Still other detailed benefits and advantages of the invention will be evident as this description proceeds.

DESCRIPTION OF THE PREFERRED EMBODIMENT

Figure 1:
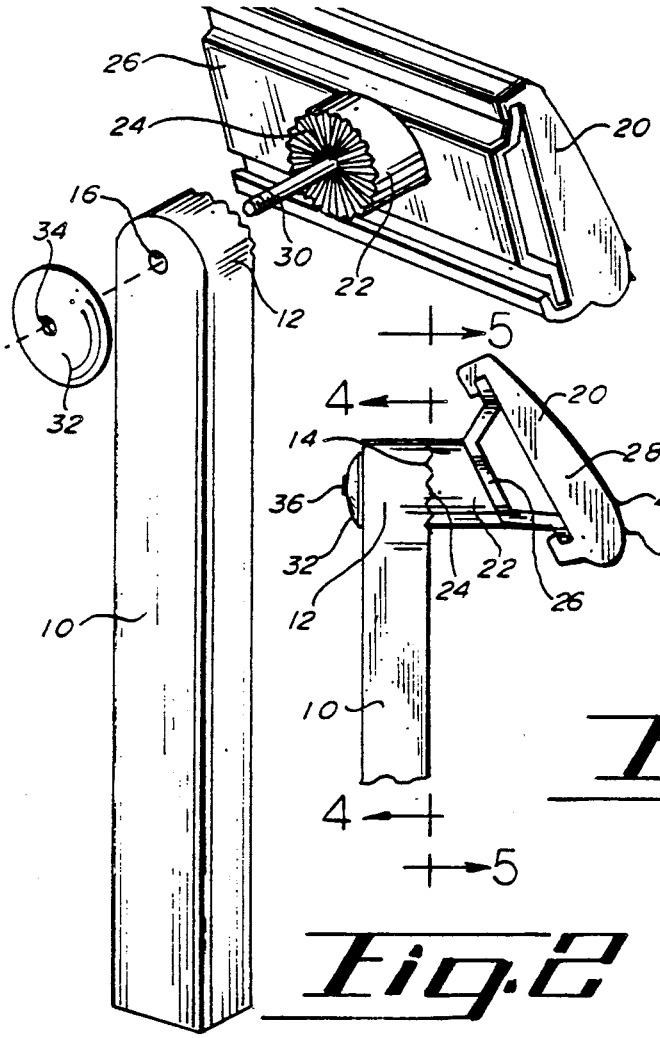
FIG. 1 is a schematic exploded view of basic parts of the new razor.
Figure 2:
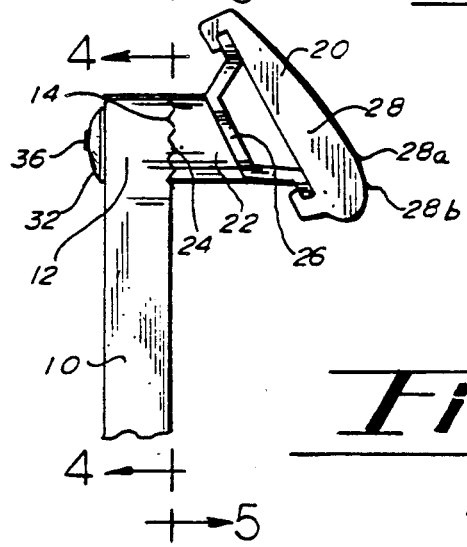
FIG. 2 is a schematic side view of the new razor in assembled condition.

Referring particularly to FIGS. 1 and 2, the new razor has an elongated handle member 10 which terminates or has fixed to one end of it a mounting boss 12 having a disc-like mating face 14 on its forward side (i.e. the side of the disc-like body facing toward the razor head). The boss 12 preferably has a central axis opening or hole 16 extending through it from its disc-like face; and this central opening is perpendicular to the disc-like mating face 14. The elongated handle is preferably other than round in cross-section to facilitate non-rotation of it as it is held by fingers in shaving; and a square or rectangular cross-section as illustrated is preferred. It may be provided with a non-slip grip of serrations on its surface.

The second major element of the new razor is a shaving safety razor head assembly 20. This head assembly has a rearwardly directed part or body which is a mounting boss 22. Boss 22 has a rearward disc-like face 24 which forms a mating face comparable in size or diameter to the mating face 14 of the mounting boss on the handle member.

The mating faces 14 and 24 of the mounting bosses 12 and 22 are surfaces made up of a multitude or plurality of radially extending grooves and ridges.

The third major element or assembly of the new razor is a biasing means for yieldably urging the mating faces of the razor head and razor handle together. Illustratively, a central axis shaft 30 may project perpendicularly from and be unified with the mating face 24 of the mounting boss 22 on the shaving razor head assembly 20. The shaft extends through the central axis hole 16 of the mounting boss 12 on the handle member. A spring means, suitably a disc spring 32 having an axis opening 34 is placed over the shaft after the shaft is inserted through the axis hole 16 of the mounting boss 12 on the handle member 10. The end of the shaft 30 projecting through the disc spring 32 is then flared or spread in any suitable manner to form a holding knob body or member which maintains the disc spring in 10 assembled condition so that it yieldably presses against the rear side of the mounting boss 12 on the handle member. That pressing action in turn presses the mating face 14 on the handle member against the mating face 24 on the shaving razor head assembly. Thus the mating faces 14 and 24 of the mounting bosses on the respective handle and head assemblies are yieldably biased into an interlocked condition because of the intermeshing of the radial grooves and ridges of one face with the radial grooves and ridges of the other face.

Figure 3:
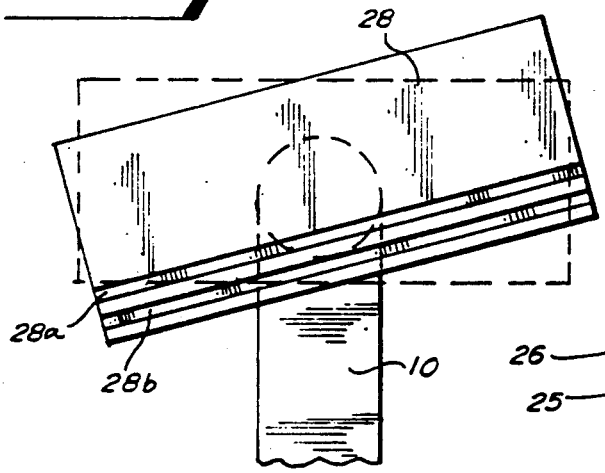
FIG. 3 is a schematic frontal view of the new razor with the transverse shaving razor head at an angular orientation with respect to the elongated handle member and includes a dash line showing an optional perpendicular or T-shape orientation for the transverse shaving razor head with respect to the handle member.

The shaving razor head assembly may be formed so that a track body member 26 forms a pair of spaced parallel opposed track elements or edges. This track member 26 suitably is the portion of the head assembly unified to the mounting boss 22 of the head. A razor cartridge 28 may, for example, comprise two spaced razor cutting edges **28*a* and 28*b* (see FIG. 3) mounted in the plastic body of the cartridge; and the cartridge is suitably equipped with spaced parallel track recesses at its rear. Such a razor cartridge may be slidably mounted on the spaced parallel track elements of the track body 26, as is conventional for cartridge replaceable razors heretofore available. However, in the case of disposable razors, the invention contemplates that the mass or body in which razor blades are mounted may be unified at its rearward portion with the mounting boss 22 of the shaver razor head 20 so as to form essentially a single completely unified head assembly including the boss 22 and shaft or rod 30. If desired, such a unified head assembly, formed economically of plastic and razor blades and lacking track means, may be employed as a replacement cartridge for the razor of the present invention, in which case the holding member for the spring 32 preferably would be in the nature of a threaded nut 36 and the shaft 30** preferably would be cooperatively threaded.

Figure 4:
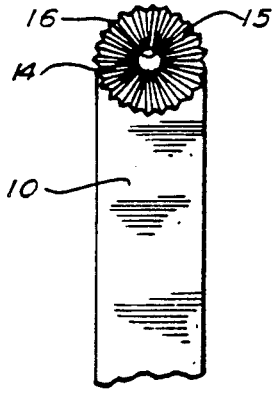
FIG. 4 is a schematic perspective view of the forward side or frontal side of the handle member and particularly illustrates the mating face of the boss thereof.
Figure 5:
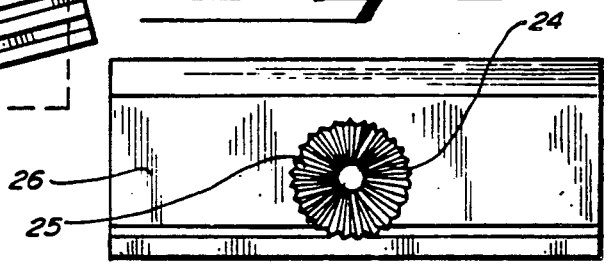
FIG. 5 is a schematic view of the rear side of the shaving razor head and particularly illustrates the rearwardly directed mating face of the mounting boss thereof.

It is emphasized that the disc-like mating faces of the mounting bosses on the elongated handle as well as the head assembly of the new razor may indeed be varied in character from that of uniform radial ridges and grooves. However, probably the most economical form for the mating faces is that wherein all radial ridges and all radial grooves are of the same size or are uniform in size. From a general descriptive standpoint, one may visualize a corrugated sheet material and visualize a radial pattern for the gracefully curved corrugations of such a sheet. In all likelihood such a radial pattern of grooves and ridges of equal character on a mating face of each mounting boss presents one of the most economical and easily engineered arrangement of radial grooves and ridges. FIGS. 4 and 5 are intended to illustrate this as well as a comparable arrangement where the grooves and ridges are of equal size but are relatively pointed at their outermost and innermost extremity (with sloping side walls extending between the outer and inner extremities of the ridges and grooves). Alternate radial lines 15 in FIG. 4, and 25 in FIG. 5, are intended to illustrate the top or outermost part of the ridges; and the lines between the alternate radial lines are intended to illustrate the bottom or innermost part of the grooves. Still further, it is conceivable that the bottom or innermost part of the radial grooves of one mating face may be relatively narrow as compared to the top or outermost part of the radial ridges on that face, with the bottom of the radial grooves commensurately wide as compared to the top of the radial ridges on the other mating face. Still other variations from equality may be possible. The fundamental point is that the radial grooves and ridges of one face must intermesh with the radial grooves and ridges of the other regardless of the relative rotational orientation of one face with respect to the other. In this sense, the radial grooves and ridges of one face are the mirror complement of the radial grooves and ridges of the other.

Still further, visualize moving circularly over the mating faces of the mounting bosses of the invention. The portion of the mating faces between the depth of grooves and the height of ridges should be sloped or gracefully curved so as to permit easy sliding indexing of the ridges and grooves on opposite faces with respect to each other. Perpendicular side walls extending from the depth of a groove to the height of a ridge are undesired because they tend to effect relatively solid interlocking which does not permit easy rotational indexing of one mating face with the respect to the other by finger action as adjustment of the angularity of the shaving head with respect to the handle of the razor is accomplished. Sloped side walls permit easy notch-like indexing shift of one face with respect to the other; and this indexing shift can be accomplished by merely using a finger of the hand holding the handle. Finger pushing or pulling of a lateral end of the transverse razor head is sufficient to effect the indexing shift to place the razor head at a desired angular orientation.

Figure 6:
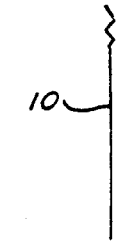
FIG. 6 is a schematic diagrammatic line view illustrating the intermeshed mating faces oriented in a plane substantially parallel to the elongated handle member for the razor.

The relative orientation of the mating faces with respect to the elongated handle member of the razor is a further consideration. As illustrated in FIG. 6, the interface of the mating faces 14 and 24, illustrated by a corrugated line in FIG. 6, preferably are parallel to the length of the elongated handle 10, which is illustrated by a straight line in FIG. 6.

Figure 7:
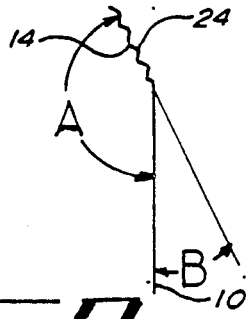
FIG. 7 is a schematic diagrammatic line view illustrating an angular relationship for the intermeshed mating faces with respect to the elongated handle member.

Optionally, if desired, the plane of interfacing of the mating faces may be at an angular relationship with respect to the elongated handle. This is illustrated in FIG. 7 where the plane of interfacing of the mating faces 14 and 24 is illustrated by a corrugated line and the handle 10 by a straight line. The angular relationship at the angle A of FIG. 7 for the plane of interfacing or intermeshing of the mating faces to the handle member preferably should be greater than about 150 degrees. At the B angle of FIG. 7, this angular relationship should be no more than about 30 degrees with respect to the length direction of the handle 10. Put another way, the mating faces 14 and 24, as illustrated in intermeshed condition in FIG. 7, lie in a plane which is angularly offset from the length direction of the elongated handle 10.

Preferably all parts of the new razor other than the cutting blades and possibly the track edges are formed by molding organic plastic material such as, for example, polystyrene or a harder plastic such as one of the phenol formaldehyde family. Even relatively flexible ethylenic plastics may be used, if desired. The handle 10 and mounting boss 12 of it are preferably unitarily molded. Likewise, the mounting boss 22 of the head 20 is most preferably molded unitarily to the rear portion of the head assembly. In this respect the track structure 26 of the new razor is preferably but not critically formed of plastic and is provided, if desired, with metalized track edges. Of course the invention also contemplates that the materials used in forming the structures may consist of any suitable material including metal.

A possible system for yieldably fastening the mounting bosses of the two basic parts of the razor may comprise a bolt. For example, the shaft unified with the boss 22 of the head 20 may be omitted (and possibly an axial recess into boss 22 formed) and a bolt may be inserted through the spring 32 and hole 16 of boss 12 and then friction fitted or pressed or otherwise anchored in boss 22.

While a disc or bell spring of concave character, as illustrated, is believed to be the most attractive biasing member for use in practicing the invention, a suitable biasing member may comprise a coiled spring, or even a leaf spring suitably anchored at one end, or a flexible plastic washer, or any other yieldable biasing system.

Thus, the invention may be embodied in other specific forms than illustrated without departing from the spirit and essential characteristics of it. The illustrated embodiment is therefore to be considered in all respects as illustrative and not restrictive, the scope of the invention being indicated by the appended claims rather than by the foregoing description; and all changes which come within the meaning and range of equivalency of the claims are therefore intended to be embraced thereby.

That which is claimed is:

1. An adjustable safety razor comprising:

a handle assembly having an elongated handle member with a hole through one end thereof, a disc-like mating face on one side of said handle member, said hole connecting said mating face to an opposite side of said handle member and having an axis perpendicular to said mating face;

a shaving razor head assembly having a mounting boss with a disc-like mating face, an axis shaft fixedly mounted thereto and protruding perpendicularly from the head assembly mating face, said axis shaft extending through said hole; each said mating face comprising a plurality of radial grooves and ridges, the radial grooves and ridges of one said mating face being a mirror complement of the radial grooves and ridges of the other said mating face;

yieldable biasing means on said shaft and adjacent said opposite side of said handle member for urging said mating faces together in intermeshed condition with constant tension as said head assembly is rotated with respect to said handle assembly circularly around the axis of said shaft by a user; and removable holding means engaging a free end of said shaft for retaining said handle member and said biasing means on said shaft, said holding means being located outwardly of said biasing means and outside of said handle member for easy removal by a hand of the user.

2. The razor of claim 1 wherein said yieldable biasing means comprises a disc spring.

3. The razor of claim 1 wherein the radial grooves and ridges of each said mating face are all substantially equal in size and uniform in shape.

4. The razor of claim 2 wherein said mating faces in intermeshed condition lie in a plane which is parallel to the longitudinal axis of the handle member.

* * * * *